US010032578B2

(12) United States Patent
Darr et al.

(10) Patent No.: US 10,032,578 B2
(45) Date of Patent: Jul. 24, 2018

(54) HIGH CURRENT, COMPACT FUSIBLE DISCONNECT SWITCH WITH DUAL SLIDER BAR ACTUATOR ASSEMBLY

(71) Applicant: EATON INTELLIGENT POWER LIMITED, Dublin (IE)

(72) Inventors: Matthew Rain Darr, Edwardsville, IL (US); Rui Guo, Shannxi (CN); Xuecheng Zhang, Shannxi (CN)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 15/391,935

(22) Filed: Dec. 28, 2016

(65) Prior Publication Data

US 2017/0110271 A1 Apr. 20, 2017

Related U.S. Application Data

(63) Continuation of application No. PCT/CN2014/081085, filed on Jun. 30, 2014.

(51) Int. Cl.

| | |
|---|---|
| ***H01H 85/20*** | (2006.01) |
| ***H01H 85/54*** | (2006.01) |
| ***H01H 21/22*** | (2006.01) |
| ***H01H 21/16*** | (2006.01) |

(52) U.S. Cl.

CPC ..... *H01H 21/16* (2013.01); *H01H 21/22* (2013.01); *H01H 85/203* (2013.01); *H01H 85/54* (2013.01); *H01H 2235/01* (2013.01)

(58) Field of Classification Search

CPC ..... H01H 21/16; H01H 21/22; H01H 85/203; H01H 85/54; H01H 2235/01

USPC ..... 337/8

See application file for complete search history.

(56) References Cited

U.S. PATENT DOCUMENTS 3,354,277 A * 11/1967 Stanback ..... H01H 9/102 337/205
3,599,135 A * 8/1971 Gryctko ..... H01H 9/10 337/236
3,614,697 A * 10/1971 Dunham ..... H01H 9/10 337/6

(Continued)

FOREIGN PATENT DOCUMENTS

CN 101635222 A 1/2010
DE 1588944 B2 12/1975

(Continued)

OTHER PUBLICATIONS

International Search Report of International Application No. PCT/CN2014/081085, dated Jan. 6, 2015, 4 pages.

(Continued)

*Primary Examiner* — Anatoly Vortman
(74) *Attorney, Agent, or Firm* — Armstrong Teasdale LLP

(57) ABSTRACT

A high current fusible disconnect switch device includes a switch housing configured to receive a pluggable touch-safe fuse module, and a dual slide bar actuator assembly for opening and closing switch contacts. The dual slide bar elements are each coupled to bias elements that store and release energy to affect switch opening and closing operations. The switch opening and closing operation is multi-staged wherein the only the first slider element is movable in the first stage, and both the first and second slider elements are movable in the second stage.

36 Claims, 10 Drawing Sheets

(56) References Cited

U.S. PATENT DOCUMENTS

| | | | | |
|---|---|---|---|---|
| 3,958,197 | A * | 5/1976 | Gryctko | H01H 83/22 335/18 |
| 3,958,204 | A * | 5/1976 | Gryctko | H01H 71/121 335/18 |
| 5,355,274 | A | 10/1994 | Marach et al. | |
| 5,559,662 | A | 9/1996 | Happ et al. | |
| 6,717,505 | B1 * | 4/2004 | Bruchmann | H01H 85/32 337/187 |
| 7,115,829 | B2 * | 10/2006 | Schmid | H01H 21/42 200/400 |
| 7,368,676 | B2 | 5/2008 | Mattlar et al. | |
| 7,474,194 | B2 * | 1/2009 | Darr | H01H 9/104 337/59 |
| 7,924,136 | B2 * | 4/2011 | Darr | H01H 9/104 337/143 |
| 8,614,618 | B2 | 12/2013 | Darr et al. | |
| 2015/0380196 | A1 | 12/2015 | Darr et al. | |

FOREIGN PATENT DOCUMENTS

| | | | |
|---|---|---|---|
| DE | 2722279 | A1 | 11/1978 |
| DE | 3011853 | A1 | 10/1980 |
| FR | 2452776 | A1 | 10/1980 |
| WO | 2012099726 | A1 | 7/2012 |

OTHER PUBLICATIONS

Written Opinion of International Application No. PCT/CN2014/081085, dated Jan. 6, 2015, 7 pages.
Extended European Search Report for Application No. 14896330.9, dated Feb. 27, 2018, 10 pages.

* cited by examiner

HIGH CURRENT, COMPACT FUSIBLE DISCONNECT SWITCH WITH DUAL SLIDER BAR ACTUATOR ASSEMBLY

CROSS REFERENCE TO RELATED APPLICATIONS

This application is a continuation application of International Application No. PCT/CN2014/081085.

BACKGROUND OF THE INVENTION

The field of the invention relates generally to fusible circuit protection devices, and more specifically to fusible disconnect switch devices configured for high current industrial applications.

Fuses are widely used as overcurrent protection devices to prevent costly damage to electrical circuits. Fuse terminals typically form an electrical connection between an electrical power source and an electrical component or a combination of components arranged in an electrical circuit. One or more fusible links or elements, or a fuse element assembly, is connected between the fuse terminals, so that when electrical current flowing through the fuse exceeds a predetermined limit, the fusible elements melt and open one or more circuits through the fuse to prevent electrical component damage.

A variety of fusible disconnect switch devices are known in the art wherein fused output power may be selectively switched from a power supply input. Existing fusible disconnect switch devices, however, have not completely met the needs of the marketplace and improvements are desired. Specifically, high current applications present additional demands on fusible switch disconnect devices that are not well met by existing fusible disconnect devices.

BRIEF DESCRIPTION OF THE DRAWINGS

Non-limiting and non-exhaustive embodiments are described with reference to the following Figures, wherein like reference numerals refer to like parts throughout the various views unless otherwise specified.

DETAILED DESCRIPTION OF THE INVENTION

Figure 1:
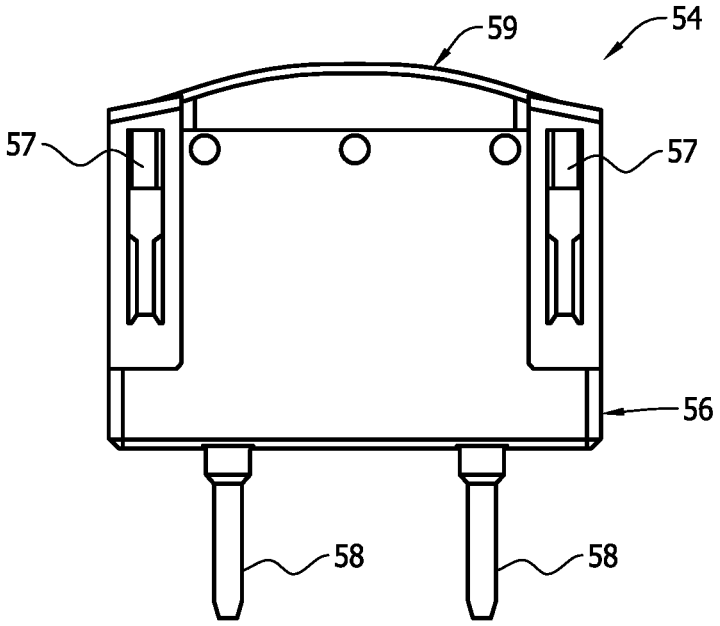
FIG. 1 is a perspective view of a touch-safe power fuse module.

Exemplary embodiments of fusible disconnect switch devices are described below with enhanced features for high current industrial power supplies. Method aspects will be in part apparent and in part explicitly discussed in the description below.

Referring now to FIGS. 1-4 an exemplary fusible disconnect switch assembly 50 includes a non-conductive switch housing 52 configured or adapted to receive a retractable rectangular touch-safe power fuse module 54. The touch-safe power fuse module 54 includes a rectangular housing 56, and terminal blades 58 extending from the housing 56. A primary fuse element or fuse assembly is located within the fuse housing 56 and is electrically connected between the terminal blades 58. The fuse module 54 is similar in some aspects to a CUBEFuse™ power fuse module commercially available from Bussmann by Eaton of St. Louis, Mo. The fuse module 54 is configured, however, for higher current industrial power applications than previously available CUBEFuse™ power fuse modules are capable of meeting. In contemplated examples the fuse module 54 may have a voltage rating of 500 VDC and an ampacity rating in contemplated examples of 200A, 400A or 600A. The switch housing 52 is likewise designed to handle such high current applications, including but not limited to an improved switching mechanism described below to more capably meet the needs of high current industrial power systems.

Figure 2:
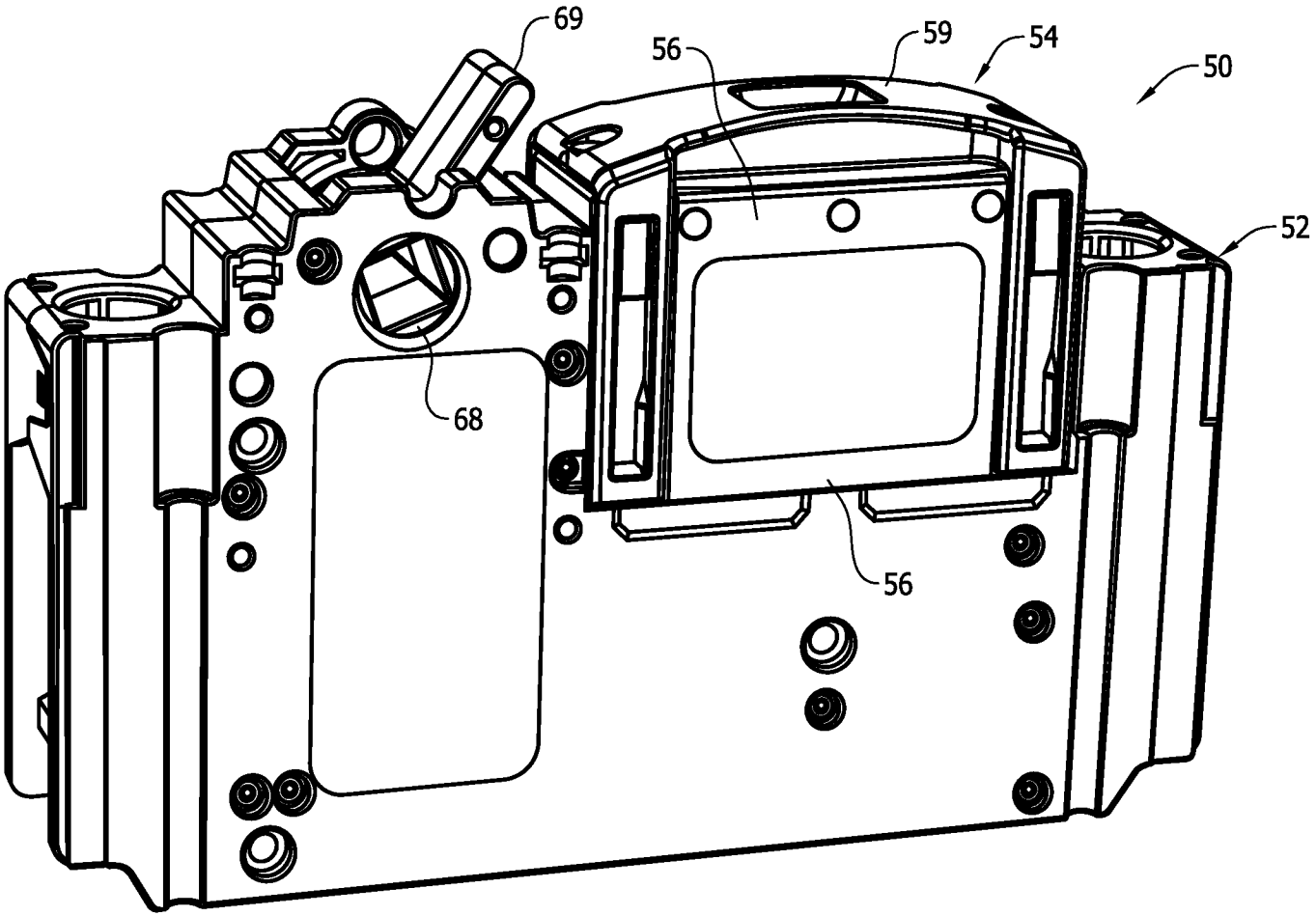
FIG. 2 is a side view of a fusible switch disconnect device including the touch-safe power fuse module shown in FIG. 1 coupled to a switch housing.
Figure 3:
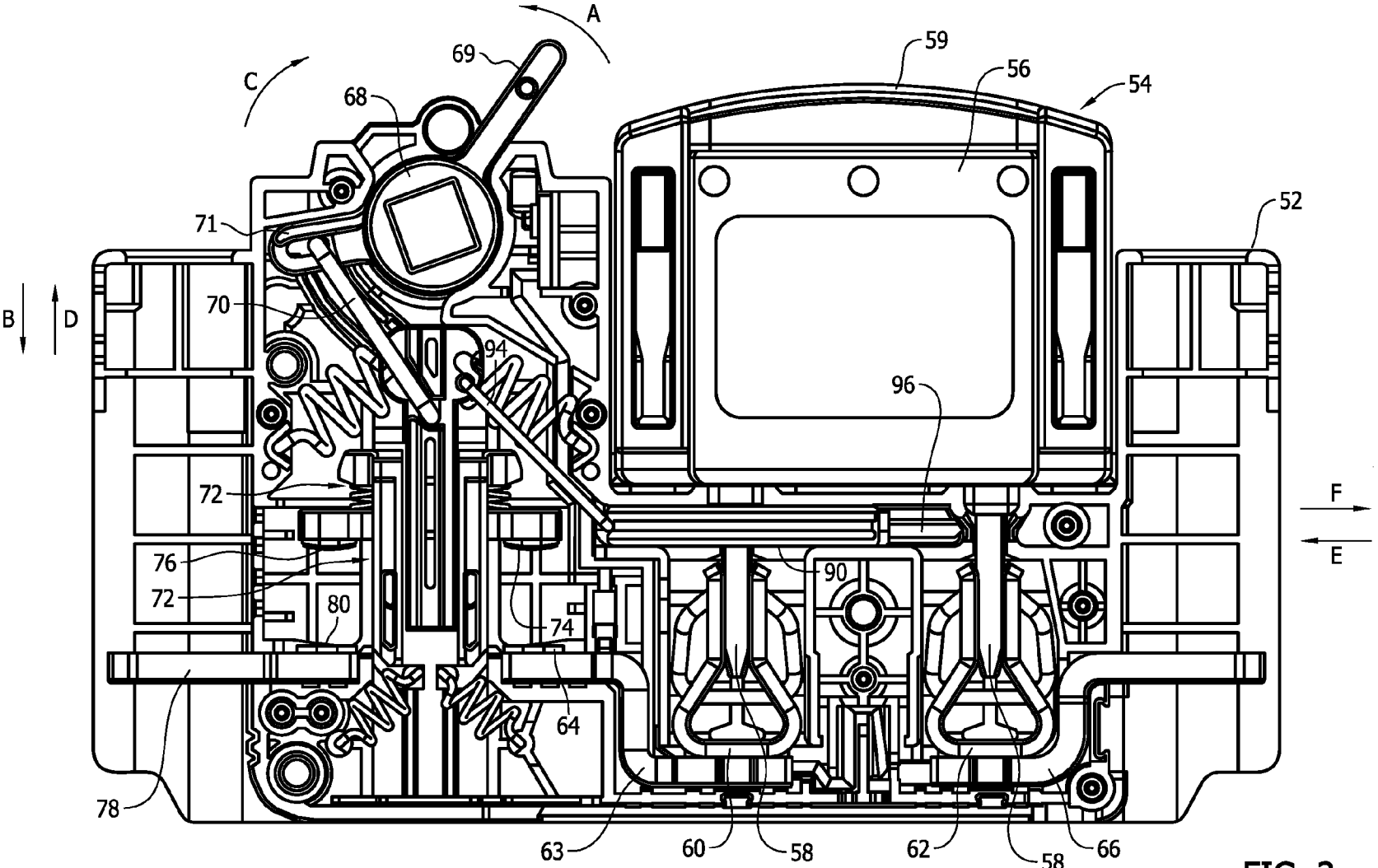
FIG. 3 is a view similar to FIG. 2 but revealing the internal components in the switch housing.
Figure 4:
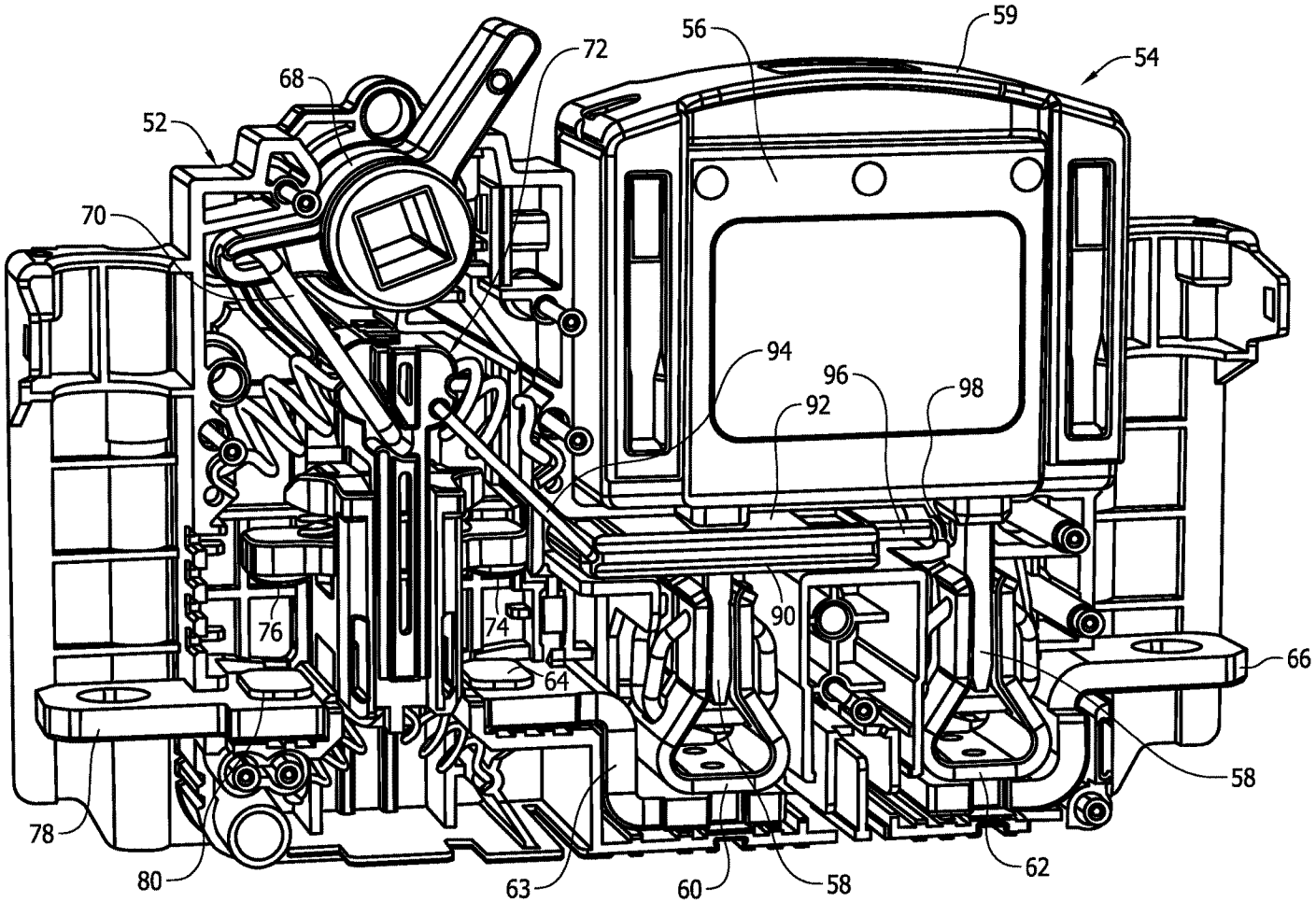
FIG. 4 is a view similar to FIG. 3 but illustrating the internal components in perspective view.

The fuse module 54 includes a built-in handle 59 that is slidably movable relative to the housing 56 from the retraced position as shown to an extended position that provides a clearance from the housing 56. The handle 59 can gripped by hand and assists in improving mechanical leverage to remove the fuse module 54 from the switch housing 52 when the fuse module 54 is plugged into the switch housing 52 as shown in FIGS. 2 through 4. Because of the high current capabilities of the fuse module 54 and the switch housing 52, an amount of force to extract the fuse module 54 is increased as compared to previously available CUBEFuse™ power fuse modules.

In the example shown, the handle 59 is attached to the exterior of the fuse housing 56 and is always present and available for use. Separately provided tools are not required to remove the fuse, and associated difficulties of locating and using separate tools are likewise eliminated. The handle 59 is slidable on the fuse housing 56 with simple and highly reliable motion, and includes elongated guide slots that interlock with protrusions 57 on the fuse housing 56 when the handle 59 is fully extended. By pulling upwardly on the handle 59 when in its extended position, the fuse terminal blades 58 can be pulled from the switch housing 52 to release the fuse module 54 with relative ease.

Referring now to FIGS. 3 and 4, a line side fuse clip 60 may be situated within the switch housing 52 and may receive one of the terminal blades 58 of the fuse module 54. A load side fuse clip 62 may also be situated within the switch housing 52 and may receive the other of the fuse terminal blades 58. The line side fuse clip 60 may be electrically connected to a line side terminal 63 including a stationary switch contact 64. The load side fuse clip 62 may be electrically connected to a load side terminal 66.

A rotary switch actuator 68 is further provided on the switch housing 52, and is formed with a lever 69 that protrudes from the switch housing 52 for manual positioning of the actuator 68 between the operating positions described below to open and close the switch mechanism including the contacts 74, 76. The switch actuator 68 is mechanically coupled to one end of an actuator link 70 via a projecting arm 71 extending radially away from a round main body of the switch actuator 68. The round body is mounted in the switch housing 52 for rotation about its center axis in the directions of arrows A and C to operate the switch mechanism.

The link 70, at its other end, is in turn coupled to a sliding actuator bar assembly 72. The actuator bar assembly 72 carries a pair of movable switch contacts 74 and 76. A line side terminal 78 including a stationary contact 80 is also provided. Electrical connection to power supply circuitry may be made to the line side terminal 78, and electrical connection to load side circuitry may be made to the load side terminal 66 in a known manner. A variety of connecting techniques are known (e.g., screw clamp terminals, box lug terminals, bolted connections, terminal stud connections, bus bar connections, and the like) and may be utilized to establish the line and load side connections to external circuitry to be protected by the fuse module 54.

Disconnect switching may be accomplished by grasping the lever 69 and rotating the switch actuator 68 from an "off" or "opened" position as shown in FIGS. 3 and 4 in the direction of arrow A (FIG. 11), causing the actuator link 70 to move the sliding actuator bar assembly 72 linearly in the direction of arrow B in sequential stages of actuation explained further below, and ultimately moving the switch contacts 74 and 76 toward the stationary contacts 64 and 80. Eventually, the switch mechanism closes when the contacts 74 and 76 become mechanically and electrically engaged to the stationary contacts 64 and 80. With the switch mechanism closed, the circuit path through the fuse module 54 between the line and load side terminals 78 and 66 is completed when the fuse terminal blades 58 are received in the line and load side fuse clips 60 and 62.

When the lever 69 is moved to rotate the switch actuator 68 in the opposite direction indicated by arrow C (FIG. 13), the link 70 causes the sliding bar assembly 72 to move linearly in the direction of arrow D in sequential stages of actuation explained further below, and ultimately pull the switch contacts 74 and 76 away from the stationary contacts 64 and 80 to open the circuit path through the fuse module 54 as shown in FIGS. 3 and 4. As such, by moving the actuator 68 to a desired position with the lever 69, the fuse module 54 and associated load side circuitry may be connected and disconnected from the line side circuitry while the line side circuitry remains "live" in full power operation. As seen in FIGS. 3 and 4, the switch actuator 68 is configured with a square internal bore that may receive an external shaft such that the switch actuator 68 may be remotely rotated in an automatic manner. In still other embodiments, the switch housing 52 may include an internal trip mechanism causing the switch actuator 68 to rotate if certain current conditions are detected and therefore prevent the fuse module 54 from opening. Current detection and control circuitry may optionally be provided to operate the trip mechanism when provided.

The fuse module 54 may also be simply plugged into the fuse clips 60, 62 or extracted therefrom to install or remove the fuse module 54 from the switch housing 52. The fuse housing 56 projects from the switch housing 52 and is accessible from the exterior of the switch housing 52 so that a person can grasp the handle 59 and pull it in the direction of arrow D to disengage the fuse terminal blades 58 from the line and load side fuse clips 60 and 62 such that the fuse module 54 is completely released from the switch housing 52. Likewise, a replacement fuse module 54 can be grasped by hand and moved toward the switch housing 52 in the direction of Arrow B to engage the fuse terminal blades 58 to the line and load side fuse clips 60 and 62.

Such plug-in connection and removal of the fuse module 54 advantageously facilitates quick and convenient installation and removal of the fuse 54 without requiring separately supplied fuse carrier elements and without requiring tools or fasteners common to other known fusible disconnect switch devices. Also, the fuse terminal blades 58 project from a lower side of the fuse housing 56 that faces the switch housing 52. Moreover, the fuse terminal blades 58 extend in a generally parallel manner projecting away from the lower side of the fuse module 54 such that the fuse housing 56 (as well as a person's hand when handling it) is physically isolated from the conductive fuse terminals 58 and the conductive line and load side fuse clips 60 and 62. The fuse module 54 is therefore touch-safe or finger-safe (i.e., may be safely handled by hand without risk of electrical shock) when installing and removing the fuse 54.

Additionally, the disconnect switch device 50 is rather compact and can easily occupy less space in a fusible panelboard assembly, for example, than conventional in-line fuse and circuit breaker combinations. In particular, the fuse module 54 occupies a smaller area, sometimes referred to as a footprint, in the panel assembly than non-rectangular fuses having comparable ratings and interruption capabilities. Reductions in the size of panelboards are therefore possible, with increased interruption capabilities.

In ordinary use, the circuit is preferably connected and disconnected at the switch contacts 64, 74, 76 and 80 rather than at the fuse clips 60 and 62. Electrical arcing that may occur when connecting/disconnecting the circuit may be contained at a location away from the fuse clips 60 and 62 to provide additional safety for persons installing, removing, or replacing fuses. By opening the disconnect module 50 with the switch actuator 68 before installing or removing the fuse module 54, any risk posed by electrical arcing or energized metal at the fuse module and housing interface is eliminated. The fusible disconnect switch 50 is accordingly believed to be safer to use than many known fused disconnect switches.

The fusible disconnect switch device 50 includes still further features, however, that improve the safety of the device 50 in the event that a person attempts to remove the fuse module 54 without first operating the switch actuator 68 to disconnect the circuit through the fuse module 54.

Figures 5, 6:
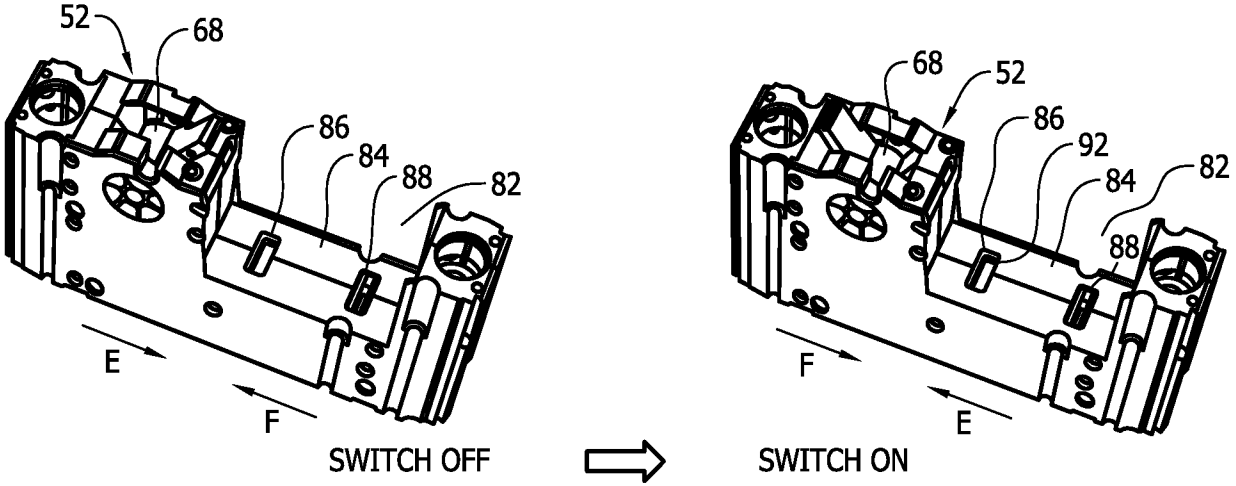
FIG. 5 is a perspective view of the switch housing with the touch-safe power fuse removed and the switch actuator in an opened or off position.
FIG. 6 is a view similar to FIG. 5 but showing the switch actuator in a closed or on position.

As shown in FIGS. 5 and 6, the switch housing 52 in one example includes an open sided receptacle or cavity 82 that accepts a portion of the fuse housing 56 when the fuse module 54 is installed with the fuse terminal blades 58 engaged to the fuse clips 60, 62. The fuse handle 59, extends above the fuse housing 56 and is easily accessible as shown in FIG. 2-4.

The switch housing receptacle 82 further includes a bottom surface 84, sometimes referred to as a floor, that includes first and second openings 86 and 88 formed therein and through which the fuse terminal blades 58 may be extended to engage them with the line and load side fuse clips 60 and 62 as seen in FIGS. 3 and 4. As seen in FIGS. 3 and 4 a slidable nonconductive interlock element 90 is provided that includes a biased safety cover 92 (FIG. 4) that closes the line side opening 86 in the switch housing fuse receptacle 82 and prevents the line side terminal blade 58 from coming into contact with the line side fuse clip 60 when the switch actuator 68 is positioned in the "closed" or "on" position as shown in FIG. 6 (i.e., fully rotated in the direction of Arrow A in FIGS. 3 and 12). As such, and as shown in FIG. 6, the safety cover 92 prevents a fuse module 54 from being installed when the switch actuator 68 is in the "on" position closing the switch contacts 74 and 76 and hence electrically connecting the line side fuse clip 60 to power supply circuitry. In such a condition the line side fuse clip 60 is "live" or energized at normal operating power, and by preventing the line side fuse terminal 58 from coming into contact with it via the safety cover 92, electrical arcing conditions that otherwise may occur are avoided entirely.

In the example shown, the interlock element 90 is coupled to the switch actuator 68 via a positioning arm or link 94, and the interlock element 90 is movable along a linear axis in the direction E or F (FIGS. 3, 5 and 6) in a direction parallel to the fuse receptacle floor 84.

When the switch actuator 68 is rotated in the direction of arrow C (FIGS. 3 and 13) to the "open" or "off" position wherein the switch contacts 74 and 76 are disengaged with the stationary contacts 64 and 80, the interlock element 90 is pulled by the link 94 along the linear axis in the direction of arrow E until an aperture or slot in the safety cover 92 (FIG. 4) is aligned with the line side opening 86 in the fuse receptacle floor 84, and hence permitting access for the line side terminal blade 58 of the fuse to extend through the line side opening 86 in the switch housing fuse receptacle 82 as seen in FIGS. 4 and 5. In this state, the safety cover 92 clears the line side opening 86 and permits plug-in connection of the line side terminal blade 58 to the line side fuse clip 60 as shown in FIG. 4. When the fuse 54 is plugged in with the interlock element 90 in this position, the line side terminal blade 58 passes through the aperture in the interlock element 90 and into the line side fuse clip 60 as seen in FIGS. 3 and 4.

When the switch actuator 68 is rotated in the direction of arrow A (FIGS. 3 and 12) to close the switch contacts 74 and 76 and turn the device "on" or "closed" as shown in FIGS. 6 and 12, the link 94 pushes the interlock element 90 and along a linear axis in the direction of arrow F until the aperture in the safety cover 92 becomes misaligned with the line side opening 86. As such, the safety cover 92 effectively blocks access to the line side fuse clip 60 through the line side opening 86 and would frustrate any effort to install the fuse module 54. The line side terminal blade 58 of the fuse module 54 would hit the safety cover 92 during any attempt to plug the fuse module 54 into the switch housing receptacle 82 in this condition. This is best shown in FIG. 6 where the line side opening 86 is blocked by the solid portion of the interlock element 90.

The safety cover 92 is movable relative to the interlock element 90 and is biased in the direction of arrow F by a spring element. When the fuse module is 54 plugged in, the safety cover 92 is biased against the line side terminal blade 58 connecting the line side fuse clip 60 with the spring compressed. When the fuse module 54 is unplugged, the bias element extends the safety cover 92 in the direction of arrow F and blocks the opening 86 as shown in FIG. 6. As such, the interlock element 90 and safety cover 92 permit rotation of the switch actuator 68 between the open and closed positions in the directions of arrow A and C while the fuse module 54 is plugged in. That, is the interlock element 90 and safety cover 92 does not interfere with closing of the switch mechanism when the fuse terminals 58 are received in the fuse clips 60 and 62. The interlock element 90 and safety cover 92 instead will only operate to block the line side opening 86 when the fuse 54 is removed from the receptacle 82.

It should now be evident that the switch actuator 68 simultaneously drives the sliding actuator bar assembly 72 along a first linear axis (i.e., a vertical axis per FIG. 3 as drawn) in the direction of arrow B or D and the interlock element 90 along a second linear axis (i.e., a horizontal axis per FIG. 3 as drawn) in the direction of arrows E or F. Specifically, as the sliding actuator bar assembly 72 is moved in the direction of arrow B, the interlock element 90 (and the attached safety cover 92) is driven in the direction of arrow F. Likewise, when the sliding actuator bar assembly 72 is moved in the direction of arrow D, the interlock element 90 and safety cover 92 are driven in the direction of arrow E. The mutually perpendicular axes for the sliding bar assembly 72 and the interlock element 90 are beneficial in that that the actuator 68 is stable in either the opened "off" position (FIGS. 3, 4 and 5) or the closed "on" position (FIG. 6) and a compact size of the disconnect switch device 50 is maintained. It is understood, however, that such mutually perpendicular axes of motion are not necessarily required for the sliding bar assembly 72 and the interlock element 90. Other axes of movement are possible and may be adopted in alternative embodiments. On this note too, linear sliding movement is not necessarily required for these elements to function, and other types of movement (e.g., rotary or pivoting movement) may be utilized for these elements if desired.

As best shown in FIGS. 3 and 4, an interlock shaft 96 is coupled to an end of the interlock element 90 opposite the link 94. The interlock shaft 96 is movable with the interlock element 90 in the direction of arrows E and F as the actuator 68 is rotated in the directions of arrows A and C and the sliding actuator bar assembly 72 in turn moves in the directions of arrows B and D. When the switch actuator 68 is fully rotated in the direction of arrow A, the interlock shaft 96 is moved in the direction of arrow F until the shaft 96 passes through an aperture 98 (FIG. 4) in the load side terminal blade 58 connecting to the load side fuse clip 62 when the fuse module 54 is plugged in. As such, the fuse module 54 cannot be removed unless that switch actuator 68 is rotated back in the direction of arrow C to the open position as shown in FIGS. 3 and 4, pulling the interlock element 90 and shaft 94 in the direction of arrow E to release the shaft 96 from the aperture 98 in the load side terminal blade 58. Only then can the fuse module 54 be removed. The safety cover and interlock features described are highly desirable when the disconnect switch assembly 50 is used in high power, high current operations, although in certain embodiments they could be considered optional and need not be included in all embodiments.

Figure 7:
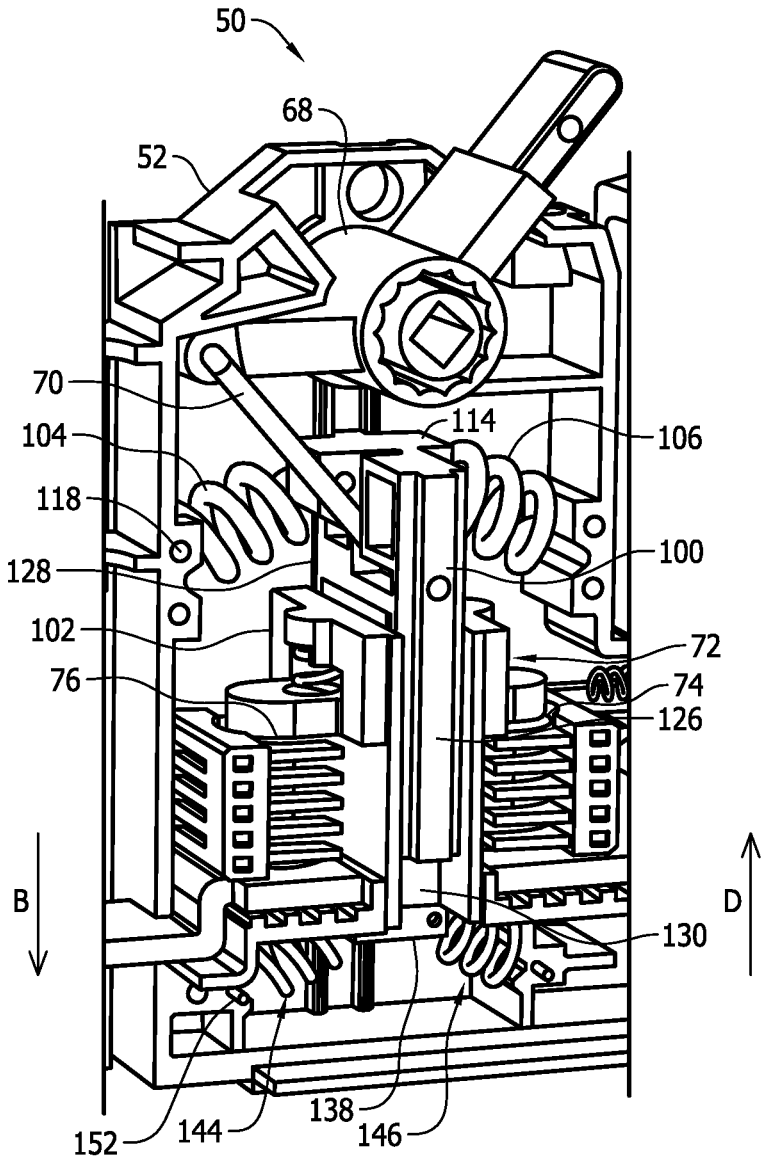
FIG. 7 is an enlarged perspective view of the switch mechanism for the switch housing shown in FIGS. 2-6.

FIG. 7 is an enlarged view of the switching mechanism including the sliding actuator bar assembly 72. The sliding actuator bar assembly 72 is linked to the switch actuator 68 via the link 70 and is responsive to the position of the switch actuator 68 to effect a switch closing operation or a switch opening operation as further explained below.

The sliding actuator bar assembly 72 includes a first or upper slider element 100 and a second or lower slider element 102 each slidably movable with respect to the switch housing 52 along a linear axis in the direction of arrows B and D. That is, in the example shown the upper and lower slider elements 100, 102 are respectively movable along coincident linear axes. The first slider element 100 further is independently movable relative to the second slider element 102. Specifically, the first slider element 100 is movable relative to the second slider element 102 in a first stage of opening and closing operations while the second slider element remains stationary. The second slider element 102 carries the movable switch contacts 74, 76 to make or break an electrical connection with the stationary contacts 64, 80 and is moved by the first slider element 100 in a second stage of the switch closing and opening operations.

Figure 8:
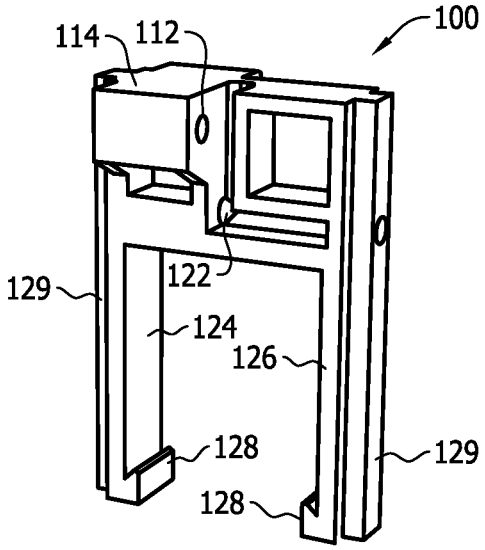
FIG. 8 is a perspective view of an upper slider element for the switch mechanism shown in FIG. 7.
Figure 9:
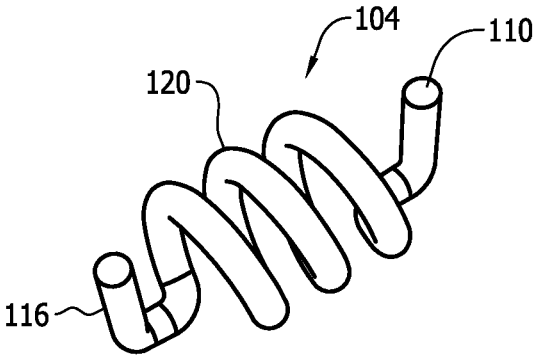
FIG. 9 is a perspective view of an exemplary bias element for the upper slider element shown in FIG. 8.

The first slider element 100 is biased by a pair of bias elements 104, 106 on either side of an upper end of the first slider element 100. As shown in FIGS. 7-9, one end 110 of the bias element 104 is coupled to the first slider element 100 when extended through an opening 112 in an enlarged head portion 114 of the first slider element 100. The other end 116 of the bias element 104 is coupled to the switch housing 52 when extended through an opening 118 in the switch housing 52. In between the ends 110, 116 the bias element 104 includes a helical compression spring portion 120.

The bias element 106 is substantially identically formed to the bias element 104 shown in FIG. 7 and is similarly connected to the first slider element 100 and the switch housing 52. Because the first slider element 100 is movable in the direction of arrows B and D along the linear axis, the bias elements 104, 106 that are mechanically connected to the first slider element 100 pivot about their ends connected to the switch housing 52 as the first slider element 100 is moved, while the opposing ends of the bias elements 104, 106 are held in place. The pivotal mounting of the bias elements 104, 106 allows them to store and release force and energy to facilitate opening and closing of the switch contacts 74, 46 as they are pivoted to different positions.

The first slider element 100 may be formed from a plastic material known in the art. In the exemplary embodiment shown in FIG. 8, the first slider element 100 includes a head section 114, a portion of which is enlarged to facilitate connection of the bias elements 104, 106. The enlarged head section 114 protrudes in opposite directions from a body of the slider element 100, and the openings 112 that receive the ends of the bias elements 104, 106 are formed in the enlarged head section. The protruding head section 114 also engages the second slider element 102 and causes it to move in a second stage of a switch opening operation as explained below. An opening 122 is also formed in the first slider element 100 for connection to an end of the link 70. Thus, whenever the switch actuator 68 rotates, the link 70 is displaced and causes the first slider element 100 to move along the linear axis in the direction of arrows B and D.

The first slider element 100 also includes first and second legs 124, 126 depending from the head section 114 in a spaced apart and generally parallel relationship. Each leg 124, 126 is formed with a protrusion in the form of a hook 128 at its distal end. The hooks 128 extend inwardly and toward one another from each leg 124, 126, and interface with the second slider element 102 in the second stage of a switch opening operation as described below. The legs 124, 126 are further formed with external ribs 129 that are received in channels formed in the switch housing 52. The ribs 129 are slidably movable relative to the housing channels and are constrained by the channels to move only in the direction of arrows B or D.

Figure 10:
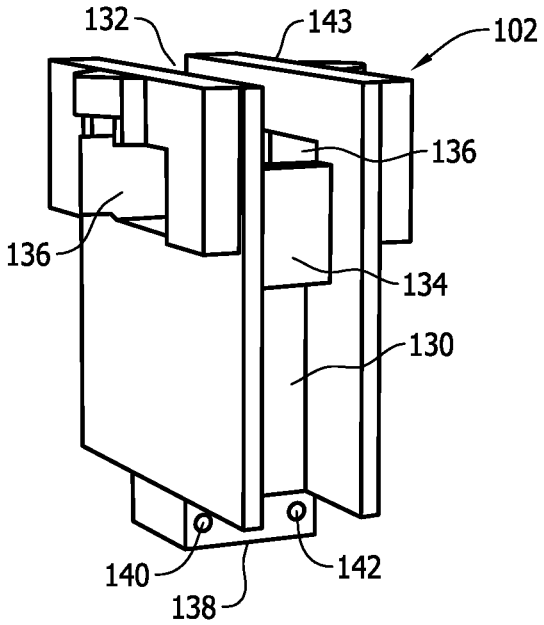
FIG. 10 is a perspective view of a lower slider element for the switch mechanism shown in FIG. 7.

The second slider element 102 (FIGS. 7 and 10) may also be formed from a plastic material known in the art. The second slider element 102 includes opposing U-shaped channels 130, 132 that receive the legs 124, 126 of the first slider element 100. The legs 124, 126 are freely slidable in the channels 130, 132 during a portion of the switch closing and opening operation. The distal ends of the legs of the U-shaped channels are received in channels formed in the switch housing 52. The second slider element 102 is accordingly slidably movable relative to the housing channels and is constrained by the housing channels to move only in the direction of arrows B or D.

Each channel 130, 132 of the second slider element 102 further includes a protrusion 134 in the form of a catch that is engaged by the hooks 128 in the legs 124, 126 of the first slider element 100 in the second stage of the switch opening operation. The second slider element 102 further includes a lateral slot 136 extending perpendicular to the channels 130, 132. A conductor bridge including the switch contacts 74, 76 is mounted in the slot 136 such that the switch contacts 74, 76 are mounted stationary to the second slider element 102. The second slider element 102 also includes a bottom 138 including openings 140, 142 that receive ends of bias elements 144, 146 that connect to the switch housing 52 at their other ends. Opposite the bottom 138, the second slider element 102 includes a mouth portion 143.

Figure 11:
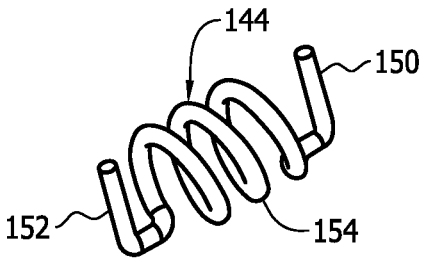
FIG. 11 is a perspective view of an exemplary bias element for the lower slider element shown in FIG. 10.

An example bias element 144 for the second slider element 102 is shown in FIG. 11 and is seen to be similar to the bias element 104 shown in FIG. 9, but is dimensionally smaller and has a relatively smaller spring constant. Like the bias element 104, the bias element 144 includes a first end 150, a second end 152 and a coil section 154 in between. One end 152 of the bias element 144 is connected to the second slider element 102 via the opening 140 in the bottom 138, and the other end 152 is extended into an opening near the bottom of the switch housing 52. The bias element 146 is substantially identically formed to the bias element 144 and is similarly connected to the second slider element 100 and the switch housing 52. Because the second slider element 100 is movable in the direction of arrows B and D along the linear axis, the bias elements 144, 146 that are mechanically connected to the second slider element 102 pivot about their ends connected to the switch housing 52 that are held in place as the second slider element 102 is moved. The pivotal mounting of the bias elements 144, 166 allows them to store and release force and energy to facilitate opening and closing of the switch contacts 74, 46 as the bias elements 144, 146 are pivoted to different positions.

Figures 12A, 12B, 12C, 12D:
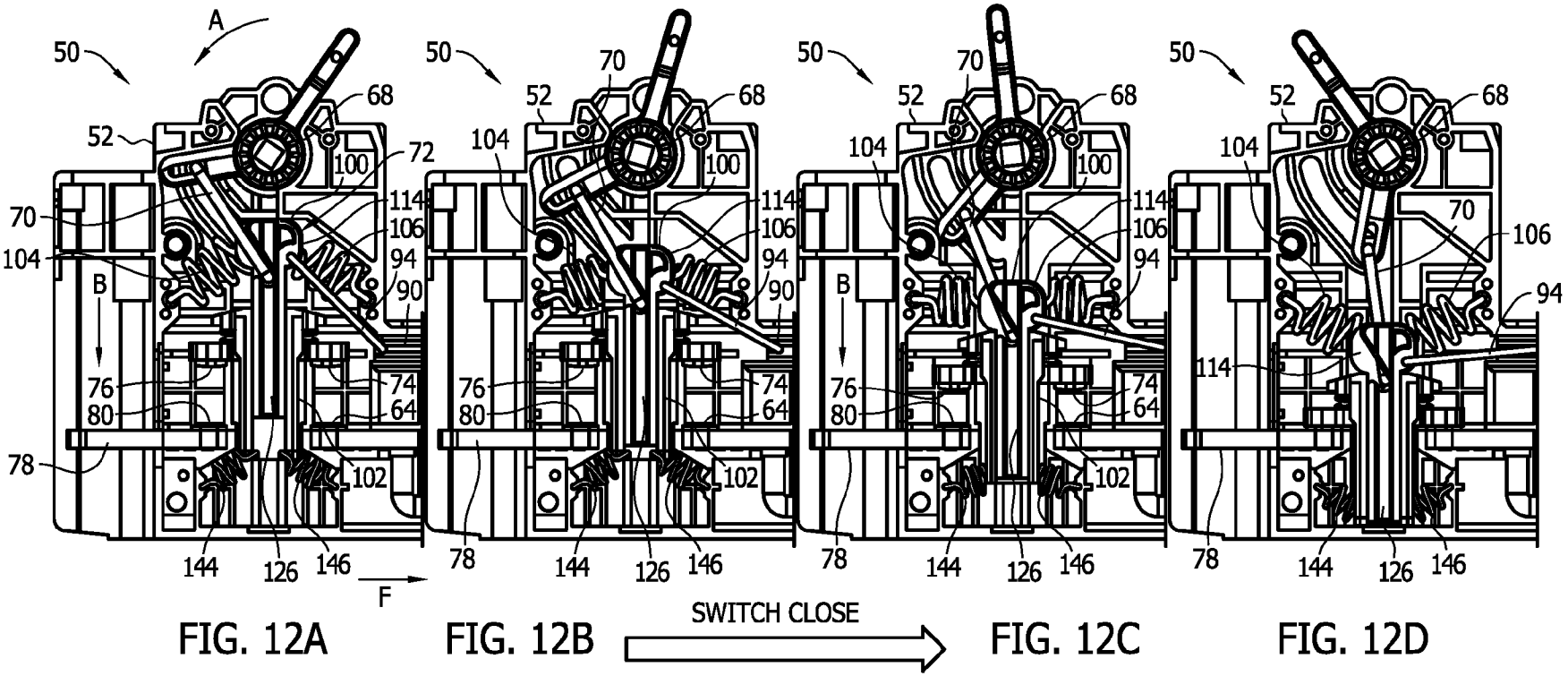
FIGS. 12A, 12B, 12C and 12D illustrate sequential activation of the switch mechanism in a switch closing operation.

The switch closing operation is illustrated in FIGS. 12A through 12D. In FIG. 12A, the switch actuator 68 is in the opened or off position and the switch contacts 74, 76 are separated from the switch contacts 64, 80.

In FIG. 12B, the switch actuator 68 is rotated in the direction of arrow A and a first stage of the switch closing operation is illustrated. In the first stage, the first slider element 100 is moved downwardly in the direction of arrow B by the link 70 as the switch actuator 68 rotates, while the second slider element 102 is maintained stationary. The bias elements 104, 106 coupled to the first slider element 100 are compressed and store energy as the first slider element 100 descends. The descending first slider element 100 also causes the bias elements 104, 106 to pivot from their initial position shown in FIG. 12A. The second slider element 102 and its bias elements 144, 146 are mechanically isolated from the first slider element 100, however, and are not affected by this stage of operation.

FIG. 12C illustrates a second stage of the switch closing operation. The first slider element 100 has now descended further and the enlarged head portion 114 of the first slider element 100 contacts the mouth portion 143 of the second slider element 102. In this stage, the second slider element 102 is driven by the first slider element 100 and the second slider element 102 moves with the first slider element 100.

That is, both of the slider elements 100, 102 descend together in this stage. As the second slider element 102 begins to move downwardly in the direction of arrow B, the bias elements 144, 146 are compressed to store energy as well as pivoted as shown. The switch contacts 74, 76 are carried downward with the second slider element 102 toward the stationary switch contacts 64, 80. In the position shown in FIG. 12C, the bias elements 104, 106 coupled to the first slider element 100 reach a maximum state of compression.

The pivoting bias elements 104 and 106 begin to decompress as they pivot past the point of equilibrium shown in FIG. 12C. Stored force in the springs as they decompress is released to drive the first slider element 100 downward apart from rotation of the switch actuator 68. Shortly after this begins to occur, the pivoting bias elements 144, 146 connected to the second slider element 102 reach their maximum state of compression and also begin to release stored force as they are further pivoted. The bias elements 144, 146 thereafter also drive the second slider element 102 downward. The combined release of force in the bias springs 104, 106, 144, 146 causes the switch contacts 74, 76 to quickly and firmly close. Because the first slider element 100 is linked directly to the switch actuator 68, the actuator is moved to the fully closed position under force. The switch mechanism closes with a secure, automatic snap action once the bias elements 104, 106, 144, 146 move past their points of equilibrium. Such quick automatic closure is advantageous for high voltage, high current power systems that present severe arcing potential.

Figures 13A, 13B, 13C, 13D:
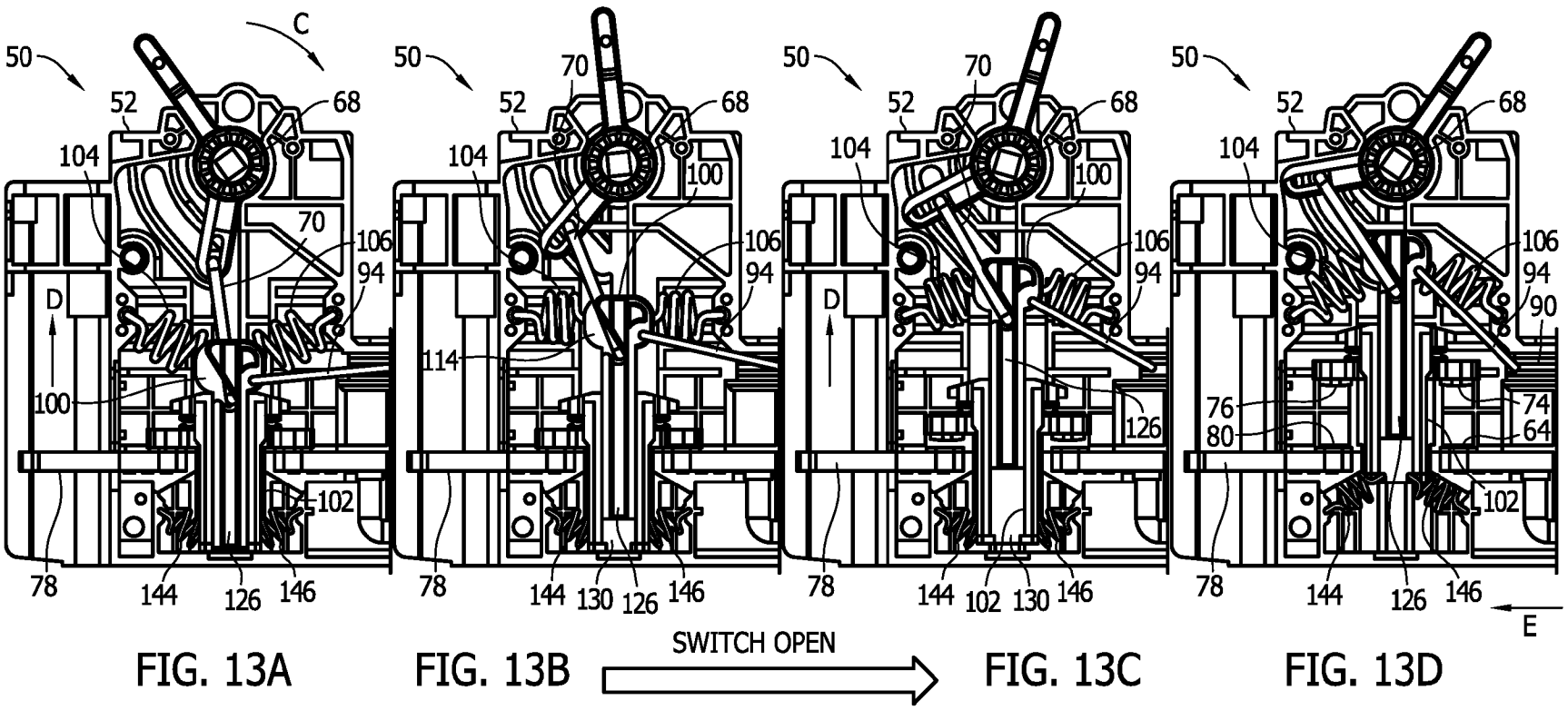
FIGS. 13A, 13B, 13C and 13D illustrate sequential activation of the switch mechanism in a switch opening operation.

FIGS. 13A through 13D illustrate the switch opening operation. In FIG. 13A, the switch actuator 68 is in the closed position (the same position shown in FIG. 12D). The switch contacts 74, 76 are closed and the circuit path through them is completed.

FIG. 13B shows a first stage of the opening operation wherein the switch actuator 68 is rotated in the direction of arrow C. In the first stage, the first slider element 100 is pulled upwardly in the direction of arrow D while the second slider element 102 remains stationary. The bias elements 104, 106 coupled to the first slider element 100 are compressed and begin to store energy as they are pivoted from their initial position shown in FIG. 13A. The second slider element 102 and its bias elements 144, 146 are mechanically isolated from the first slider element 100 and are not affected by this stage of operation In FIG. 13C the switch actuator 68 is further rotated and the first slider element 100 has been lifted an amount sufficient to cause the first slider element legs 124, 126 and the hook protrusions 128 (FIG. 8) to engage the catch protrusions 134 (FIG. 10) of the second slider element 102. The first and second slider elements 100, 102 are now mechanically coupled and ascend together with the first slider element 100 driving upward movement of the second slider element 102. The bias elements 144, 146 connected to the second slider element 102 are compressed and begin to store energy as they are pivoted from their initial position shown in FIG. 13A when the second slider element 102 begins to move.

As shown in FIG. 13C, the bias elements 104, 106 coupled to the first slider element 100 have pivoted past the point of equilibrium and are now releasing stored energy to force the first slider element 100 upward and drive the switch contacts 74, 76 away from the stationary contacts 64, 80. The released force on the first slider element 100 accelerates the upward movement of the second slider element 102 that is now engaged to the first slider element 100 and causes the bias elements 144, 146 connected to the second slider element 102 to pivot past their points of equilibrium. As this happens the bias element 144, 146 also start to release stored energy to drive the second slider element 102 upward and drive the switch contacts 74, 76 away from the stationary contacts 64, 80 with increased force. In this stage, all of the bias elements 104, 106, 144, 146 cooperate to drive the switch mechanism to the fully opened position.

The combined release of force in the bias springs 104, 106, 144, 146 causes the switch contacts 74, 76 to quickly open and separate. Because the first slider element 100 is linked directly to the switch actuator 68, the actuator 68 is moved to the final open position shown in FIG. 13D (the same position shown in FIG. 12A) under force. The switch mechanism opens with a secure, automatic snap action once the bias elements 104, 106, 144, 146 move past their points of equilibrium. Such quick automatic opening is advantageous for high voltage, high current power systems that present severe arcing potential.

The benefits of the inventive concepts described are now believed to have been amply illustrated in relation to the exemplary embodiments disclosed.

An embodiment of a fusible disconnect switch device has been disclosed including: a switch housing configured to accept a pluggable fuse module; a line side terminal and a load side terminal in the switch housing; a switch actuator selectively positionable between an opened position and a closed position; and a slider assembly linked to the switch actuator and responsive to the position of the switch actuator to effect a switch closing operation or a switch opening operation; wherein the slider assembly comprises a first slider element and a second slider element each slidably movable with respect the switch housing along a linear axis; wherein the first slider element is independently movable relative to the second slider element; and wherein the second slider element carries at least one switch contact to make or break an electrical connection to one of the line and load side terminals.

Optionally, the fusible disconnect switch device may include at least one bias element coupled to the first slider element. The at least one bias element may store energy in a first stage of the switch closing operation and may release energy in a second stage of the switch closing operation. The at least one bias element may store energy in a first stage of the switch opening operation and may release energy in a second stage of the switch opening operation. The at least one bias element may be pivotally mounted in the switch housing. The at least one bias element may include a pair of bias elements.

As further options, a first bias element may act on the first slider element and a second bias element may act on the second slider element, wherein the second bias element is mechanically isolated from the switch actuator in a first stage of the switch closing operation. The first and second bias elements each may provide a closing force in a second stage of the switch closing operation. The second bias element may be mechanically isolated from the switch actuator in a first stage of the switch opening operation. The first and second bias elements each may provide an opening force in a second stage of the switch opening operation.

In a first stage of the switch closing operation the first slider element may be driven to move by the switch actuator while the second slider element remains stationary. In a second stage of the switch closing operation the second slider element may be driven by the first slider element. In a first stage of the switch opening operation the first slider element may be driven to move by the switch actuator while the second slider element remains stationary. In a second stage of the switch opening operation the second slider element may be driven by the first slider element.

The first slider element may include a first protrusion configured to engage a first portion of the second slider element in the switch closing operation. The first slider element further may include a second protrusion configured to engage a second portion of the second slider element in the switch opening operation. The first slider element may include a head section and opposing first and second legs depending from the head section. The first protrusion may extend from the head section and the second protrusion may extend from one of the first and legs. The second slider element may be configured to receive the first slider element. The second slider element may define at least one channel, a portion of the first slider element may be received in the at least one channel. The second slider element may include a catch configured to engage the first slider element in the switch opening operation.

The second slider element may carry a pair of switch contacts. A first mechanical link may also be provided and connect the switch actuator to the first slider element. A slidable interlock element may also be provided and a second mechanical link may connect the first slider element and the slidable interlock element. The slidable interlock element may be movable along a liner axis. A safety cover may also be provided and may be movable along the linear axis. The safety cover may prevent installation of the fuse module in a first position. The switch actuator may rotatably mounted to the switch housing. The fuse module may include spaced apart terminal blades, with the switch housing including terminal blade openings to accept the terminal blades.

Another embodiment of a fusible disconnect switch device has been disclosed including: a switch housing; a pair of stationary switch contacts in the switch housing; a rotary switch actuator selectively positionable between an opened position and a closed position; and a slider assembly linked to the switch actuator and responsive to the position of the switch actuator to effect a switch closing operation or a switch opening operation, wherein the slider assembly comprises: a first slider element slidably movable with respect the switch housing along a linear axis; a first pair of bias elements acting on the first slider element; a second slider element slidably movable with respect the switch housing along a linear axis coincident with the first axis; a second pair of bias elements acting on the second slider element; wherein the first slider element is independently movable relative to the second slider element and wherein the second pair of bias elements is mechanically isolated from the first pair of bias elements in at least a portion of the switch opening operation and the switch closing operation; and wherein the second slider element carries a pair of switch contact to make or break an electrical connection with the pair of stationary contacts.

Optionally, the first and second pair of bias elements may collectively store and release energy to effect the switch opening and switch closing operations. The first slider element may be movable while the second slider element is stationary in a first stage of a switch opening operation. The second slider element may be driven by the first slider element in a second stage of a switch opening operation. The first slider element may be movable while the second slider element may be stationary in a first stage of a switch closing operation. The second slider element may be driven by the first slider element in a second stage of a switch closing operation.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A fusible disconnect switch device comprising:

a switch housing configured to accept a pluggable fuse module;

a line side terminal and a load side terminal in the switch housing;

a switch actuator selectively positionable between an opened position and a closed position; and a slider assembly linked to the switch actuator and responsive to a position of the switch actuator to effect a switch closing operation or a switch opening operation;

wherein the slider assembly comprises a first slider element and a second slider element each slidably movable with respect to the switch housing along a linear axis, a first bias element acting on the first slider element and a second bias element acting on the second slider element;

wherein the first slider element is independently movable relative to the second slider element;

wherein the second slider element carries at least one switch contact to make or break an electrical connection to one of the line side terminal and the load side terminal;

wherein the second bias element is mechanically isolated from the switch actuator in a first stage of the switch opening operation; and wherein the first and second bias elements each provide an opening force in a second stage of the switch opening operation.

2. The fusible disconnect switch device of claim 1, wherein each of the first and second bias elements are pivotally mounted in the switch housing.

3. The fusible disconnect switch device of claim 1, wherein the first bias element comprises a first pair of bias elements acting on the first slider element and the second bias element comprises a second pair of bias elements acting on the second slider element.

4. The fusible disconnect switch device of claim 3, wherein the first and second pairs of bias elements store energy in a first stage of the switch opening operation and release energy in a second stage of the switch opening operation.

5. The fusible disconnect switch device of claim 4, wherein the first pair of bias elements and the second pair of bias elements are each pivotally mounted in the switch housing.

6. The fusible disconnect switch device of claim 5, wherein the first pair of bias elements attach to opposing sides of the first slider element.

7. The fusible disconnect switch device of claim 1, wherein in the first stage of the switch opening operation the first slider element is driven to move by the switch actuator while the second slider element remains stationary.

8. The fusible disconnect switch device of claim 7, wherein in the second stage of the switch opening operation the second slider element is driven to move by the first slider element.

9. The fusible disconnect switch device of claim 8, wherein the first slider element includes a first protrusion configured to engage a first portion of the second slider element in the second stage of the switch opening operation.

10. The fusible disconnect switch device of claim 9, wherein the first slider element further includes a second protrusion configured to engage a second portion of the second slider element in a switch closing operation.

11. The fusible disconnect switch device of claim 10, wherein the first slider element comprises a head section and opposing first and second legs depending from the head section.

12. The fusible disconnect switch device of claim 11, wherein the first protrusion extends from one of the first and second legs and the second protrusion extends from the head section.

13. The fusible disconnect switch device of claim 1, wherein the second slider element is configured to receive the first slider element.

14. The fusible disconnect switch device of claim 13, wherein the second slider element defines at least one channel, a portion of the first slider element being received in the at least one channel.

15. The fusible disconnect switch device of claim 14, wherein the second slider element includes a catch configured to engage the first slider element in the second stage of the switch opening operation.

16. The fusible disconnect switch device of claim 1, wherein the second slider element carries a pair of switch contacts.

17. The fusible disconnect switch device of claim 1, further comprising a first mechanical link connecting the switch actuator to the first slider element.

18. The fusible disconnect switch device of claim 17, further comprising a slidable interlock element and a second mechanical link connecting the first slider element and the slidable interlock element.

19. The fusible disconnect switch device of claim 18, wherein the slidable interlock element is movable along a linear axis.

20. The fusible disconnect switch device of claim 19, further comprising a safety cover movable along the linear axis and preventing installation of the pluggable fuse module in a first position.

21. The fusible switch disconnect device of claim 1, wherein the switch actuator is rotatably mounted to the switch housing.

22. The fusible disconnect switch device of claim 1, wherein the pluggable fuse module comprises spaced apart terminal blades, the switch housing including terminal blade openings to accept the terminal blades.

23. A fusible disconnect switch device comprising:

a switch housing configured to accept a pluggable fuse module;

a line side terminal and a load side terminal in the switch housing;

a switch actuator selectively positionable between an opened position and a closed position; and a slider assembly linked to the switch actuator and responsive to a position of the switch actuator to effect a switch closing operation or a switch opening operation, a first bias element acting on the first slider element and a second bias element acting on the second slider element;

wherein the slider assembly comprises a first slider element and a second slider element each slidably movable with respect to the switch housing along a linear axis;

wherein the first slider element is independently movable relative to the second slider element;

wherein the second slider element carries at least one switch contact to make or break an electrical connection to one of the line side terminal and the load side terminal; and wherein the second bias element is mechanically isolated from the switch actuator in a first stage of the switch closing operation.

24. The fusible disconnect switch device of claim 23, wherein the first and second bias elements each provide a closing force in a second stage of the switch closing operation.

25. The fusible disconnect switch device of claim 24, wherein in the first stage of the switch closing operation the first slider element is driven to move by the switch actuator while the second slider element remains stationary.

26. The fusible disconnect switch device of claim 25, wherein in second stage of the switch closing operation the second slider element is driven to move by the first slider element.

27. The fusible disconnect switch device of claim 23, wherein the first bias element comprises a first pair of bias elements acting on the first slider element and the second bias element comprises a second pair of bias elements acting on the second slider element.

28. The fusible disconnect switch device of claim 27, wherein the first and second pairs of bias elements store energy in a first stage of the switch opening operation and release energy in a second stage of the switch opening operation.

29. The fusible disconnect switch device of claim 28, wherein the first pair of bias elements and the second pair of bias elements are each pivotally mounted in the switch housing.

30. The fusible disconnect switch device of claim 23, wherein the second slider element carries a pair of switch contacts.

31. A fusible disconnect switch device comprising:

a switch housing;

a pair of stationary switch contacts in the switch housing;

a rotary switch actuator selectively positionable between an opened position and a closed position; and a slider assembly linked to the rotary switch actuator and responsive to a position of the switch actuator to effect a switch closing operation or a switch opening operation, wherein the slider assembly comprises:

a first slider element slidably movable with respect to the switch housing along a linear axis;

a first pair of bias elements acting on the first slider element;

a second slider element slidably movable with respect the switch housing along an axis coincident with the first linear axis;

a second pair of bias elements acting on the second slider element;

wherein the first slider element is independently movable relative to the second slider element and wherein the second pair of bias elements is mechanically isolated from the first pair of bias elements in at least a portion of the switch opening operation and in a portion of the switch closing operation; and wherein the second slider element carries a pair of switch contacts to make or break an electrical connection with the pair of stationary contacts.

32. The fusible disconnect switch device of claim 31, wherein the first and second pair of bias elements collectively store and release energy to effect the switch opening and switch closing operations.

33. The fusible disconnect switch device of claim 31, wherein the first slider element is movable while the second slider element is stationary in a first stage of the switch opening operation.

34. The fusible disconnect switch device of claim 33, wherein the second slider element is driven by the first slider element in a second stage of the switch opening operation.

35. The fusible disconnect switch device of claim 31, wherein the first slider element is movable while the second slider element is stationary in a first stage of the switch closing operation.

36. The fusible disconnect switch device of claim 35, wherein the second slider element is driven by the first slider element in a second stage of the switch closing operation.

* * * * *